United States Patent [19]

Dale, deceased et al.

[11] Patent Number: 4,923,112

[45] Date of Patent: May 8, 1990

[54] MULTIPLE PART SALES FORM

[76] Inventors: William F. Dale, deceased, late of Marietta; by Debra L. Dale, executrix, 4106 Manor House Dr., Marietta, both of Ga. 30062

[21] Appl. No.: 284,081

[22] Filed: Dec. 14, 1988

[51] Int. Cl.[5] ..... B65D 27/06

[52] U.S. Cl. ..... 229/69; 229/73; 282/11.5 A

[58] Field of Search ..... 229/69, 73; 282/11.5 R, 282/11.5 A

[56] References Cited

U.S. PATENT DOCUMENTS

| | | | |
|---|---|---|---|
| 3,312,385 | 4/1967 | Amort | 229/73 |
| 3,419,286 | 12/1968 | Noonan et al. | 282/11.5 A |
| 3,428,237 | 2/1969 | Dowen | 229/69 |
| 3,476,307 | 11/1969 | Faltin et al. | 229/69 |
| 3,837,565 | 9/1974 | Johnsen | 229/73 X |
| 3,941,307 | 3/1976 | Van Malderghem | 229/69 |
| 4,051,995 | 10/1977 | Wieman | 282/11.5 A X |
| 4,211,434 | 7/1980 | Reese | 282/11.5 A |
| 4,497,509 | 2/1985 | Gore | 229/69 X |
| 4,625,909 | 12/1986 | Ferrando | 229/69 X |
| 4,669,652 | 6/1987 | Seguin | 229/69 X |
| 4,715,531 | 12/1987 | Stewart et al. | 229/73 |
| 4,747,535 | 5/1988 | Haase et al. | 229/69 |

*Primary Examiner*—Stephen Marcus
*Assistant Examiner*—Jes F. Pascua
*Attorney, Agent, or Firm*—James B. Middleton

[57] ABSTRACT

A multiple part form is arranged with portions of the form longitudinally for one-pass printing by a computer printer. A four part form can be printed, the upper portion providing all shipping documents while the lower portion provides all billing documents. An invoice is integral with an envelope and the envelope can be stuffed with other materials for advertising or the like.

6 Claims, 2 Drawing Sheets

MULTIPLE PART SALES FORM

SUMMARY OF THE INVENTION

This invention relates generally to multiple part forms, and is more particularly concerned with a multiple part sales form including a bill of lading.

The present invention provides a multiple part form having the information and parts of the form designed in a top-to-bottom arrangement so the form can be fed through a computer printer and the entire form will be printed in one pass. The form is particularly suited for sales transactions in that the single multiple part form includes all the necessary forms for handling the shipment, and the billing therefor.

The preferred embodiment of the invention includes standard perforated edges to allow the forms to be fed continuously through a computer printer having a conventional tractor thereon. After printing, the various parts of the form are removed as needed so that all documents for tracking the shipment are included. The final portion of the form constitutes an envelope having a self contained invoice, the envelope allowing inclusion of advertisements or the like.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE INVENTION

Figure 1:
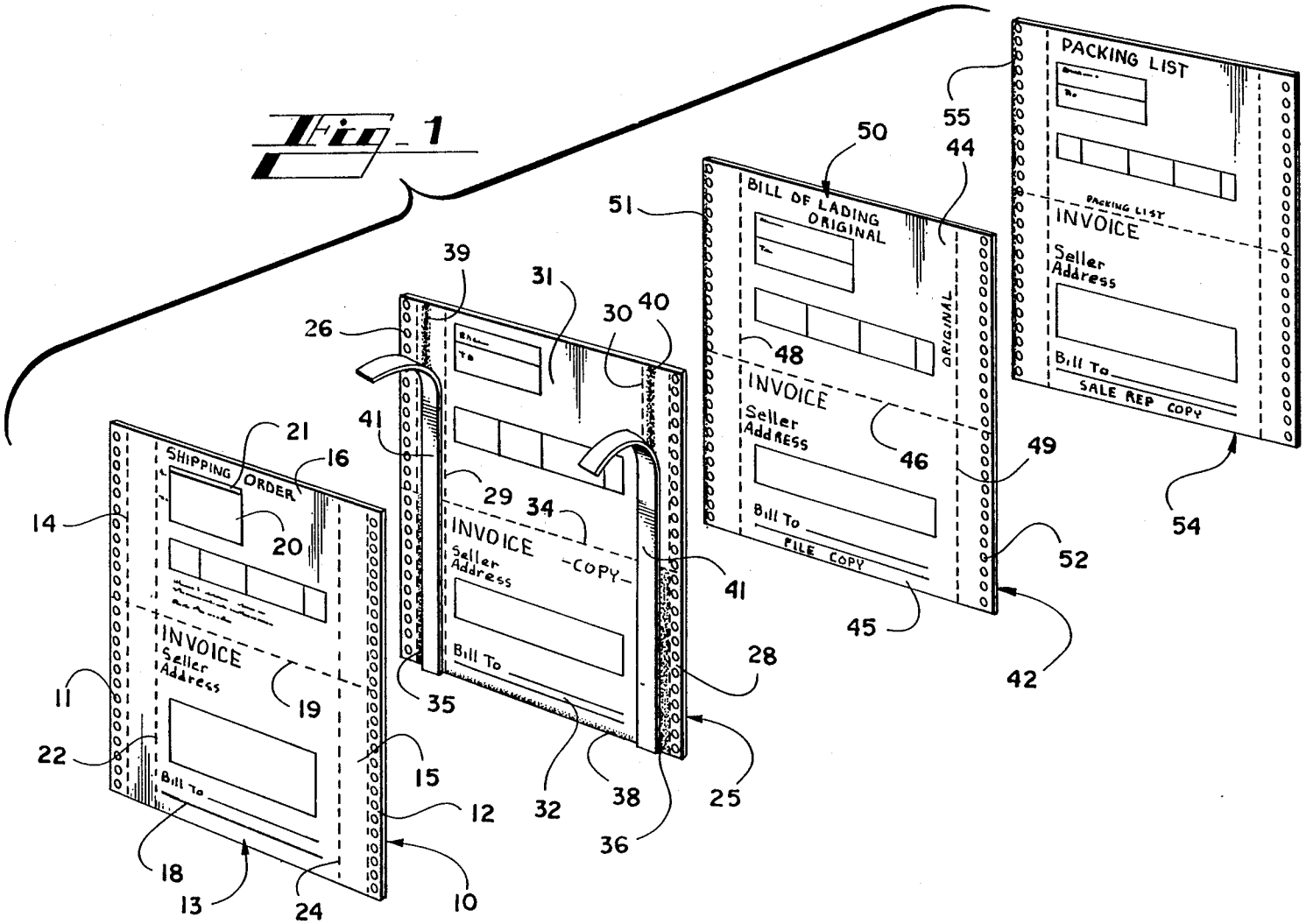
FIG. 1 is an exploded perspective view showing the construction of the multiple layers constituting a form made in accordance with the present invention.

Referring now more particularly to the drawings, and to that embodiment of the invention here presented by way of illustration, FIG. 1 shows the four parts of the form for an understanding of the various parts and how the parts are manufactured. Each of the four parts will be discussed in detail, and the assembly and cooperation of the individual parts will be discussed subsequently.

The first part of the form shown in FIG. 1 is designated generally at 10 and includes perforated feeding strips 11 and 12. As is known in the art, the strips 11 and 12 define a plurality of holes therein for receipt of the drive pins of a tractor. The strips are selectively removable from the sheet 13 at perforations 14 and 15 respectively.

The sheet 13 includes an upper portion 16 and a lower portion 18 separated by a transverse perforation 19. The upper portion 16 contains the shipping information as will be discussed in more detail hereinafter, and the lower portion 18 contains the billing information as will also be discussed in more detail below.

The upper portion 16 includes a stencil 20. As will become clear later, the names and addresses of the sender and the designee will be printed on the stencil 20. With one printing, the stencil 20 is provided for addressing boxes or cartons, and the various copies of the form also receive the same information. The stencil 20 is held to the sheet 18 by easily removable tape 21 to facilitate removal for use.

The lower portion 18 of the first part 10 contains the billing information, and it will be noted that the "Bill To" is at the bottom of the form. The importance of this location will become apparent later. Further, the entire first part 10 of the form has perforations 22 and 24 inwardly of and parallel to the perforations 14 and 15. The perforations 22 and 24 allow the original invoice of the lower portion 18 to be removed.

The second part of the form in FIG. 1 is designated at 25, and the second part has the feeding strips 26 and 28, and parallel perforations 29 and 30. The upper portion 31 is separated from the lower portion 32 by a transverse perforation 34. It will therefore be seen that the first part 10 is very similar to the second part 25.

The second part 25 partially forms an envelope with the first part 10. There are glue lines 35 and 36 just inwardly of the strips 26 and 28, and there is a glue line 38 along the bottom of the lower portion 32. These three glue lines fix the lower portion 18 of the first part to the second part to form a pocket.

To complete the envelope formed between the first part 10 and the second part 25, strips of pressure sensitive adhesive are provided. These strips are designated at 39 and 40, and are covered by release papers 41. It will be noted that the pressure sensitive adhesive strips 39 and 40, as well as the release papers 41, extend the full length, or vertical distance, of the form 25.

Looking next at the third part of the form, the third part is designated at 42, and includes an upper portion 44 and a lower portion 45 separated by the transverse perforation 46. There are vertically extending perforations 48 and 49 which coincide with the perforated lines 29 and 30 of the second part 25; and, it will be noted that these perforations 48 and 49 separate the sheet 50 from the feeding strips 51 and 52.

Finally, the fourth part of the form is designated at 54 and is constructed like the third part 42. Due to the identity in structure, the fourth part will not be described in detail. It should be noted however that there is a glue line 55 along the extreme left-hand side of the fourth part. This glue line 55 holds the third and fourth parts together until they are intentionally disassembled.

Looking next at the printed material on the form of the present invention for an understanding of the use of the form, the upper portion 16 of the first part 10 has the shipping information, including "to" and "from", and the quantity, item, etc. as is conventional. The upper portion of the first part can therefore be used as the shipping order. The upper portion 31 of the second part 25 contains the same information, and acts as the customer copy. The upper portion 44 of the third part 42 is the bill of lading, and will have the required legal language thereon. The upper portion of the fourth part 54 again has the same information and acts as the packing list.

Remembering that the lower portions 18 and 32 of the first and second parts 10 and 25 form an envelope, it will be realized that the lower portion 18 is the original invoice, and the lower portion 32 is a copy for the customer's records. The lower portion 45 of the third part 42 is the file copy for the shipper, and the lower portion of the fourth copy 54 is the sales representative's copy for keeping track of shipments.

Figure 2:
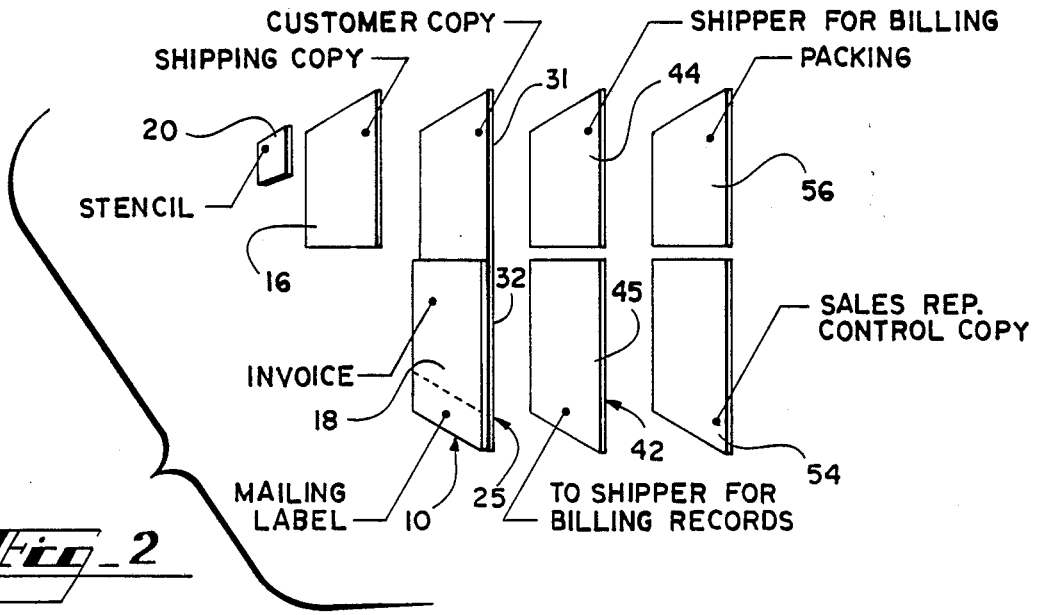
FIG. 2 is a schematic illustration to show the separations of the form of FIG. 1; and, FIG. 3 is a perspective view showing the envelope constituting a part of the form of the present invention.

Attention is next directed to FIG. 2 of the drawings, with some reference to FIG. 1. FIG. 2 shows the separation of the complete form, and the purpose of each piece. A description of the normal process using this particular form should bring about a full understanding.

First, it will be realized that the entire form is designed to have consistent construction along its vertical length. This is important so that conventional automatic machinery can create the form without separate operations, and at a maximum rate of speed. Next, the form can be fed into a computer printer, the forms being well adapted to be in a continuous sheet and fan folded for handling with a computer. The feeding strips allow a conventional printer tractor to feed the form through the printer.

Looking at FIG. 1 it will be remembered that all four of the parts contain the same information. As a result, carbonless paper ("NCR" paper) can be used to transfer the image to all four copies with one impression.

After the form has been printed, the stencil 20 can be removed and used to address the shipping cartons. The upper portion 16 is retained to have a record of the shipment, and the upper portion 56 of the fourth part 54 is packed with the carton as the packing slip. At this point, the remainder of the form is placed on a clip board to travel with the shipment.

When the shipment is delivered to the customer, the balance of the form will be returned to the shipper. The upper portion 44 is used by the shipper to bill for shipping charges, and the lower portion 45 is held by the shipper to maintain accounts receivable records. The lower portion 18 of the first part 10 and the lower portion 32 of the second part 25 make up an envelope, and the upper portion 31 of the second part 25 constitutes the flap of the envelope.

It will be remembered that the lower portion 18 is the original invoice, so the envelope can be mailed to the customer, and the invoice is thereby mailed. The customer can retain the lower portion 32, separating the invoice and copy on the perforations 22, 24 and 29, 30.

Figure 3:
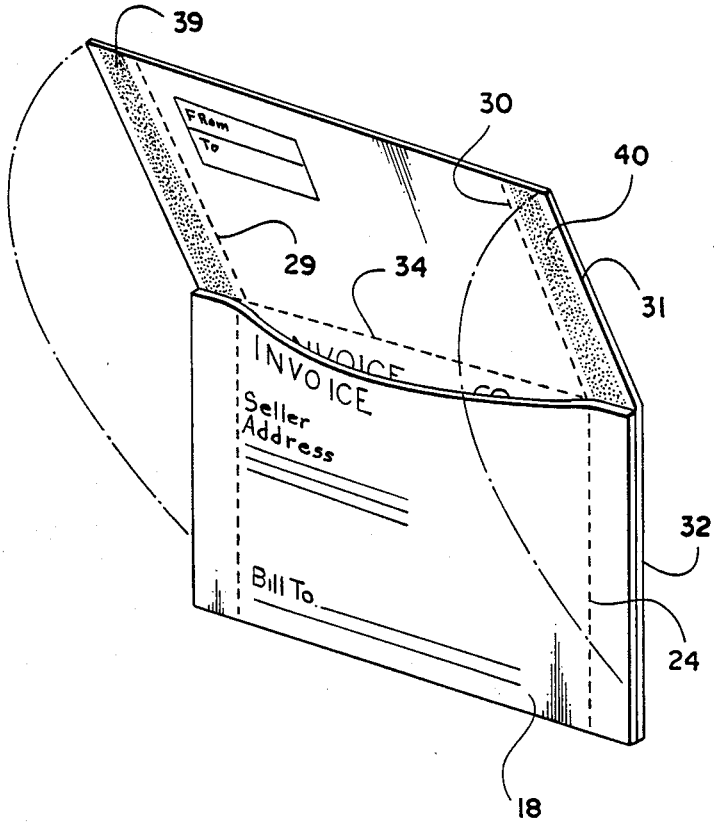

FIG. 3 shows the envelope in more detail, and it will be seen that the envelope provides a definite pouch between the lower portions 18 and 32 so that advertisements or other material can be stuffed into the pouch to be delivered for the same fee. The invoice will normally be sent as First Class Mail, requiring that the sender pay for one ounce. Advertising and the like up to one ounce can therefore be sent without additional postage expense. Since the flap 31 of the envelope is shorter than the body, or pouch, of the envelope, the "Bill To" information will be visible when the envelope is sealed. This feature allows all printing to be on one side of the forms for efficiency.

From the foregoing description, those skilled in the art will understand that the form of the present invention provides one form that can be mass manufactured, and the one form provides all pieces necessary for handling a shipment. The form is printed on a computer printer in one pass through the printer, and the one form provides records for the shipper as well as records for shipment. After proof of delivery, the same form provides an invoice for billing the customer.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. A multiple part form, said form including a first part, a second part, a third part and a fourth part juxtaposed and coincident with one another, each of said parts including feed strips for allowing said form to be engaged by a printer tractor, said feed strips being disposed longitudinally along opposite edges of said parts, each of said parts further including an upper portion and a lower portion, said upper and lower portions being selectively separable by perforations extending laterally of said parts, said first part and said second part further defining a first line of perforations for removing said feed strips from said first part and second part, and a second line of perforations parallel to said first line of perforations and inwardly of said first line of perforations, said second part including glue lines extending adjacent and parallel to said first line of perforations from said perforations extending laterally of said part to the bottom edge of said second part and a glue line extending along said bottom edge of said second part, said glue lines being adapted to adhere said second part to the back of said first part, said third part and said fourth part defining a third line of perforations and a fourth line of perforations respectively for removing said feed strips from said third part and fourth part, said third and fourth lines of perforations being coincident with said second line of perforations, the arrangement being such that removal of the feed strips from the right-hand edge of said four parts removes only the feed strips from said first part and said second part along said first line of perforations and shortens the width of said third part and fourth parts for separation of said third part and fourth part from said first part and second part.

2. A multiple part form as claimed in claim 1, wherein said upper portion is shorter than said lower portion, said second part further including a pair of strips of pressure sensitive adhesive between said first line of perforations and said second line of perforations, and release paper covering said pressure sensitive adhesive.

3. A multiple part form as claimed in claim 2, said first part further including a stencil removably fixed to said upper portion.

4. A multiple part form as claimed in claim 3, each of said upper portions including an address area, said stencil covering said address area of said upper portion of said first part, the arrangement being such that all of said four parts receive address material simultaneously with the cutting of said stencil for addressing boxes.

5. A multiple part form as claimed in claim 4, said first part and said second part forming an envelope wherein said upper portion of said second part constitutes a flap for said envelope, said lower portion of said first part including an invoice address area along the lower edge thereof, said flap being so dimensioned that said flap can close said envelope without covering said invoice address.

6. A multiple part form as claimed in claim 5, and including means for adhering the left-hand edge of said third part to said second part, and means for adhering the left-hand edge of said fourth part to said third part.

* * * * *